US005376522A

United States Patent [19]

Takiguchi et al.

[11] Patent Number: 5,376,522

[45] Date of Patent: Dec. 27, 1994

[54] SILVER HALIDE PHOTOGRAPHIC MATERIAL

[75] Inventors: Hideki Takiguchi; Tomoyuki Nakayama; Nobuaki Kagawa; Hakubun Ohashi, all of Hino, Japan

[73] Assignee: Konica Corporation, Tokyo, Japan

[21] Appl. No.: 111,263

[22] Filed: Aug. 24, 1993

Related U.S. Application Data

[63] Continuation of Ser. No. 667,192, Mar. 8, 1991, abandoned.

[30] Foreign Application Priority Data

Mar. 16, 1990 [JP] Japan ..... 2-66257
Jul. 5, 1990 [JP] Japan ..... 2-178834

[51] Int. Cl.[5] ..... G03C 1/035; G03C 1/09

[52] U.S. Cl. ..... 430/567; 430/600; 430/605; 430/612; 430/614

[58] Field of Search ..... 430/567, 600, 605, 612, 430/614

[56] References Cited

U.S. PATENT DOCUMENTS

| | | | |
|---|---|---|---|
| 2,597,856 | 5/1952 | Damschroder | 430/605 |
| 2,597,915 | 5/1952 | Yutzy et al. | 430/605 |
| 2,642,361 | 6/1953 | Damschroder | 430/605 |
| 4,477,564 | 10/1984 | Cellone et al. | 430/567 |
| 4,772,545 | 9/1988 | Nishiyama et al. | 430/612 |
| 4,835,095 | 5/1989 | Ohashi et al. | 430/567 |
| 4,906,558 | 3/1990 | Mücke et al. | 430/550 |
| 4,945,037 | 7/1990 | Saitou | 430/567 |
| 4,963,467 | 10/1990 | Ishikawa et al. | 430/567 |
| 5,049,484 | 9/1991 | Deaton | 430/605 |
| 5,049,485 | 9/1991 | Deaton | 430/605 |

FOREIGN PATENT DOCUMENTS

| | | |
|---|---|---|
| 313949 | 5/1989 | European Pat. Off. . |
| 264525 | 2/1989 | German Dem. Rep. . |

OTHER PUBLICATIONS

Trivelli et al., *Phot. J.,* 79,330 (1939).

*Journal fur Signalaufzeichnungmaterialien,* 5, No. 6, pp. 449–455, Nov. 1977.

*Primary Examiner*—Janet C. Baxter

*Attorney, Agent, or Firm*—Frishauf, Holtz, Goodman & Woodward

[57] ABSTRACT

A silver halide photographic material having photographic constituent layers on a support, which photographic material is characterized in that at least one of said photographic constituent layers is a silver halide emulsion layer, at least 50% in number of the light-sensitive silver halide grains in said silver halide emulsion layer being grains that contain at least 60 mol % of silver bromide, and at least one of said photographic constituent layers containing at least one of the compounds represented by the following general formula (I):

$$[HlAu_m(L)_n(X)_p]_q \quad (I)$$

where L is a ligand in a 5- or 6-membered hetero ring; X is an anionic group; l is an integer of 0–2; m is an integer of 1 or 2; n is an integer of 1–3; p is an integer of 0–3; and q is an integer of 1–4. The silver halide photographic material has high sensitivity and yet it is improved in protection against deterioration in its photographic performance such as increased fog and degraded granularity due to storage after manufacture.

4 Claims, No Drawings

SILVER HALIDE PHOTOGRAPHIC MATERIAL

This application is a continuation of application Ser. No. 07/667,192, filed Mar. 8, 1991 (abandoned).

BACKGROUND OF THE INVENTION

This invention relates to silver halide photographic materials, more particularly to a technique for reducing the increase in fogging and the resultant deterioration in granularity during prolonged storage of high-sensitivity photographic materials.

The recent advances in various sensitizing techniques have been remarkable and ultrahigh-sensitivity color photographic materials having speeds of 1000 and above in ISO designation are commercially available today. Heat- or moisture-initiated fogging during prolonged storage has been a well known problem with high-sensitivity photographic materials but the advent of more sensitive products has highlighted new problems that should by no means be neglected and they are the increase in fogging due to the effects of so-called "natural radiations" (i.e., environmental radiation and cosmic rays) and the resulting deterioration in granularity.

It has been reported that the fogging due to prolonged storage of high-sensitivity silver halide photographic materials and the resultant deterioration in granularity depend upon the inherent sensitivity of silver halide grains, the contents of silver and gold in photographic materials and the amount of potassium ions. Under these circumstances, the present inventors noted gold sensitizers as one of the factors to aging deterioration during prolonged storage of high-sensitivity photographic materials. Inorganic gold complex salts have been commonly used as gold sensitizers (see, for example, U.S. Pat. No. 2,399,083). Among the inorganic gold complex salts, chloroauric acid, potassium chloroaurate, potassium aurithiocynate and auric trichloride are currently used as advantageous gold sensitizers. However, these gold complex salts are prone to liberate gold and part of the liberated gold will form a stronger complex with gelatin and remain in the latter thereafter. Hence, deterioration in the performance of photographic materials that results from the use of gold sensitizers can be dealt with as a problem associated with the chemical properties of the gold sensitizers.

SUMMARY OF THE INVENTION

An object, therefore, of the present invention is to provide a high-sensitivity silver halide photographic material that is improved in protection against deterioration in its photographic performance such as increased fog and degraded granularity due to storage after manufacture.

As a result of the intensive studies conducted in order to attain this object, the present inventors found that it could be achieved by the following and the present invention has been accomplished on the basis of this finding.

(1) A silver halide photographic material having photographic constituent layers on a support, at least one of said photographic constituent layers being a silver halide emulsion layer, at least 50% in number of the light-sensitive silver halide grains In the silver halide emulsion layer being grains that contain at least 60 mol % of silver bromide, and at least one of said photographic constituent layers containing at least one of the compounds represented by the following general Formula (I):

$$[HlAu_m(L)_n(X)_p]_q \quad (I)$$

(where L is a ligand in a 5- or 6-membered hetero ring; X is an anionic group; l is an integer of 0–2; m is an integer of 1 or 2; n is an integer of 1–3; p is an integer of 0–3; and q is an integer of 1–4); and (2) A process for producing a silver halide photographic material that contains in at least one photographic constituent layer silver halide grains at least 50% in number of which are grains that contain at least 60 mol % of silver bromide, which process is characterized in that silver halide grains are chemically ripened in the presence of a compound represented by the general formula (I).

DETAILED DESCRIPTION OF THE INVENTION

In the general formula (I), X represents an anionic group as exemplified by a halide ion (e.g. fluoride, chloride, bromide or iodide ion), a perchlorate ion, a borofluorate ion, a sulfate ion, a nitrate ion and a thiocyanate ion. The ligand in a 5- or 6-membered hereto ring that is represented by L may be an anionic, cationic or neutral monocyclic group which is selected from among the groups represented by the following general formulas (II) and (III):

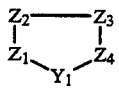

[II]

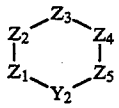

[III]

In the general formulas (II) and (III), $Y_1$ and $Y_2$ each represents an oxygen atom, a sulfur atom, a selenium atom or $=NR_1$ group; $Z_1$–$Z_5$ each represents

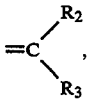

$=C(R_3)-$, $-C=W$, $=NR_1$, $-N=$, an oxygen atom, a sulfur atom or a selenium atom; at least one of $Z_1$–$Z_4$ represents $=C=W$ or $=CHSH$, provided that W represents an oxygen atom, a sulfur atom, a selenium atom or $NR_1$, that $R_1$ represents a hydrogen atom, an alkyl group, an aryl group or a heterocyclic group, and that $R_2$ and $R_3$ each represents an alkyl group, an aryl group, a heterocyclic group, a halogen atom, a hydroxyl group, a mercapto group, an alkoxy group, an alkylthio group, an aryloxy group, an arylthio group, a heteroxy group, a heterothio group, an amino group, a phosphonyl group, a carboxyl group, an alkoxycarbonyl group, an aryloxycarbonyl group, a sulfo group, an imido group, a carbamoyl group, a sulfamoyl group, an acyl group, a cyano group, an acyloxy group, a carbamoyloxy group, a silyloxy group, a ureido group, a sulfamoylamino group, a nitro group, a sulfonyl group, a sulfinyl group, an acylamino group, an alkoxycarbonylamino group, an aryloxycarbonyloxy group, a sulfonamido group.

In the general formula (II), $Y_1$ and $Z_1$–$Z_4$ combine together to form a 5-membered hetero cyclic group as exemplified by the following groups: pyrrole groups such as 2(1H)-pyrroline, 2-pyrrolidinium, 2(3H)-pyrroline and pyrronium groups; imidazole groups such as 2(3H)-imidazoline, 2-imidazolinium, 2(3H)-imidazoline and imidazolium groups; oxazole groups such as 2(3H)-oxazolidine, 2-oxazolinium, 2(3H)-oxazoline and oxazolium groups; isoxazole groups such as 3(2H)-isoxazoline and 3-isoxazolium groups; thiazole groups such as 2(3H)-thiazolium, 2-thiazolium, 2(3H)-thiazoline and thiazolium; isothiazole groups such as 3(2H)-isothiazoline and 3-isothlazolium groups; selenazole groups such as 2(3H)-selenazolidine and selenazolium; oxazolldlne groups such as 2-thio-oxazolidine-2,4-dione, 2,4-oxazolidinedione, oxazolidin-4-one and 2-oxazolin-4-one groups; thiazolidine groups such as 2-thio-thiazoline-2,4-dione, 2,4-thiazolidinedione, thiazolidin-4-one and 2-thiazolin-4-one groups; imidazolidine groups such as 2-thio-imidazolidine-2,4-dione, 2,4-imidazolidinedione, isothiazolidin-4-one and 2-imidazolidin-4-one groups; and selenazolidine groups such as 2-thio-selenazolidine -2,4-dione, 2,4-selenazolidinedione, selenazolidin-4-one and 2-selenazolin-4-one groups.

In the general formula (III), $Y_2$ and $Z_1$–$Z_5$ combine together to form a 6-membered heterocyclic group as exemplified by the following groups: pyridine groups such as 1,2-dihydro-2-pyridylidene, 2-pyridinium, tetrahydropyridine-2,4-dione and tetrahydropyridine-2,6-dione groups, pyrimidine groups such as tetrahydropyrimidine-2,4-dione, tetrahydropyrimidine-2,6-dione, hexahydropyridine-2,4,6-trione and 2-thiohexahydropyridine-2,4,6-trione groups; and pyrazoline groups such as pyrazolin-5-one and pyrazolidine-3,5-dione groups.

Examples of $R_1$–$R_3$ in the substituents on the hetero rings in the general formulas (II) and (III) are given below: alkyl groups such as straight or branched unsubstituted alkyl groups (e.g. methyl, ethyl, propyl, amyl, 2-ethylhexyl, dodecyl, 2-hexyldecyl and octadecyl), cycloalkyl groups (e.g. cyclopentyl and cyclohexyl) and substituted alkyl groups (e.g. 2-carboxyethyl, 2-hydroxyethyl, 2-methanesulfonylaminoethyl, 2-methoxyethy, 2-(2-methoxyethoxy)ethyl, 2-methanesulfonylethyl, 3-sulfopropyl and trifluoromethyl); aryl groups including both substituted and unsubstituted aryl groups such as phenyl, 4-t-butylphenyl, 2,4-di-t-amylphenyl, 4-nitrophenyl, 3-nitrophenyl, 4-methanesulfonylphenyl, 3-methanesulfonylaminophenyl, 2,4,6-trichlorophenyl, 4-trifluorophenyl, 2-methoxyphenyl, 2-acetylaminophenyl and 2-(2-ethylureido)-phenyl; and heterocyclic groups, which may be substituted or unsubstituted, including 2-pyridine, 2-furyl, 2-pyrimidyl, 2-thienyl, 5-nitro-2-thienyl, 4-methyl-2-thiazolyl and 1-pyrodinyl.

Other examples of $R_2$ and $R_3$ are listed below: halogen atoms such as fluorine, chlorine, bromine and iodine atoms; alkoxy groups, which may be substituted or unsubstituted, including methoxy, ethoxy, propoxy, 2-methoxyethoxy, 2-methylthioethoxy, 2-methanesulfonylethoxy and 2-dodecyloxy groups; aryloxy groups, which may be substituted or unsubstituted, including phenoxy, 2-methylphenoxy and 4-t-butylphenoxy groups; heteroxy groups such as 1-phenyltetrazol-5-oxy and 2-tetrahydropyranyloxy groups; acyloxy groups such as acetoxy and butanoyloxy groups; carbamoyloxy groups such as methylcarbamoyloxy and phenylcarbamoyloxy groups; silyloxy groups such as trimethylsiloxy and dibutylmethylsilyloxy groups; alkylthio groups, which may be substituted or unsubstituted, including methylthio, octylthio, tetradecylthio, octadecylthio, 3-phenoxypropylthio and 3-(4-t-butylphenoxy)-propylthio groups; arylthio groups such as phenylthio, 2-butoxy-5-t-octylphenylthio, 3-pentadecylphenylthio, 2-carboxyphenylthio and 4-tetradecanamidophenylthio groups; heterothio groups such as 2-benzothiazolylthio, 2,4-diphenoxy-1,3,5-triazole-6-thio and 2-pyridylthio groups; acylamino groups such as acetamido, butanamido and benzamido groups; amino groups such as amino, anilino, 2-hydroxyanilino, 2-mercaptoanilino, N-acetylanilino, methylamino and N,N-diethylamino groups; ureido groups such as 2-phenylureido, 2-methylureido and 2,2-dibutylureido groups; sulfamoylamino groups such as N,N-dipropylsulfamoylamino and N-methyl-N-decylsulfamoylamino groups; sulfonamido groups such as methanesulfonamido, butanesulfonamido, hexanesulfonamido, benzenesulfonamido, p-toluenesulfonamido and 2-methylthio-5-hydroxybenzenesulfonamido groups; alkoxycarbonylamino groups such as methoxycarbonylamino and butoxycarbonylamino groups; aryloxycarbonylamino groups such as a phenoxycarbonylamino group; carbamoyl groups such as N-ethylcarbamoyl, N,N-dibutylcarbamoyl, N-(2-methoxydlethyl)carbamoyl and N,N-dimethylcarbamoyl groups; sulfamoyl groups such as N-ethylsulfamoyl, N,N-dipropylsulfamoyl and N,N-dimethylsulfamoyl groups; sulfonyl groups such as methanesulfonyl, butanesulfonyl, benzenesulfonyl and p-toluenesulfonyl groups; sulfinyl groups such as ethanesulfinyl and 3-phenoxypropylsulfinyl groups; phosphonyl groups such as phenoxyphosphonyl, ethoxyphosphonyl and phenylphosophonyl groups; alkoxycarbonyl groups such as methoxy carbonyl and butoxycarbonyl groups; aryloxycarbonyl groups such as phenoxycarbonyl and p-anisldyl groups; acyl groups such as acetyl, 3-carboxypropanoyl, benzoyl and p-mercaptobenzoyl groups; and imido groups such as N-succinylimido, N-phthalimido and 3-allylsuccinylimido groups.

The following are specific but non-limiting examples of the compounds of the general formula (I) that can be used in the present invention.

I-1

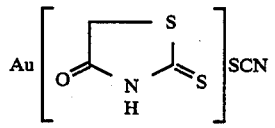

I-2

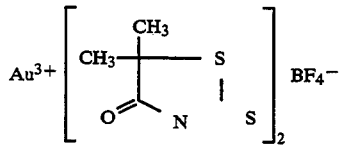

I-3

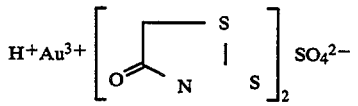

-continued

I-4

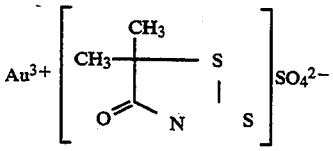

I-5

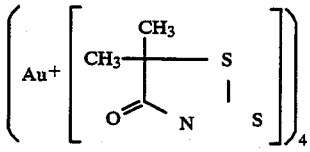

I-6

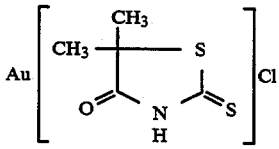

I-7

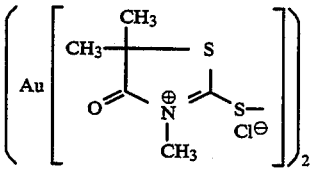

I-8

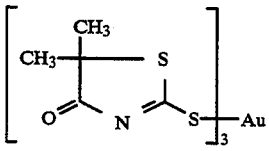

I-9

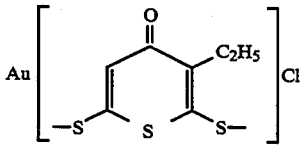

I-10

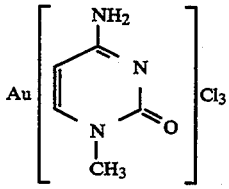

I-11

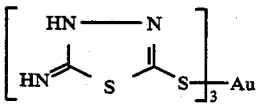

I-12

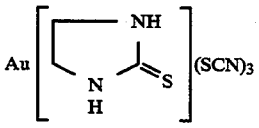

I-13

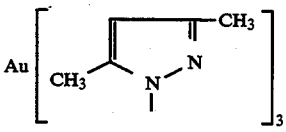

-continued

I-14

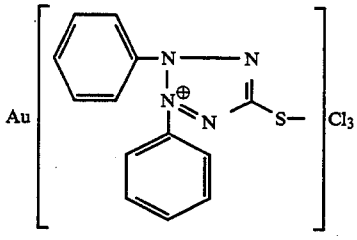

I-15

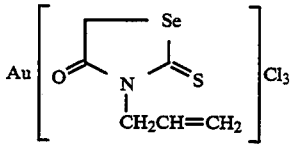

The gold compounds to be used in the present invention can be synthesized by known methods such as those described in Bull. Chem. Soc. Japan, 48 (3), 1024–1029, 1975, J. Inorg. Nucl. Chem., Vol. 38 (1), 7–11, 1976, Transition Met. Chem., Vol. 2 (6), 224–227, 1977, and Unexamined published Japanese Patent Application No. 147537/1989.

The gold compounds thus synthesized are preferably added to silver halide emulsions as solutions in water or water-miscible solvents such as methanol, ethanol, and fluorinated alcohols, which may be used either alone or as admixtures. Gold compounds that are slightly soluble in appropriate solvents are preferably added in the form of dispersions.

The gold compounds may be added at any stage of the process of emulsion preparation but they are preferably added at the start of, during or just before the completion of chemical ripening.

The amount in which the gold compounds are to be used varies with such factors as the type of silver halide emulsion, the type of gold compound used and the conditions of ripening. Preferably, they are used in amounts of $1\times10^{-4}$ to $1\times10^{-8}$ mole per mole of silver halide, with the range of $1\times10^{-5}$ to $1\times10^{-8}$ mole being more preferred.

In the present invention, chemical ripening may be performed in combination with the use of other chemical sensitizers such as sulfur sensitizers. A suitable sulfur sensitizer may be selected from among sulfur crystals, water-soluble sulfide salts, thiosulfates, thioureas. mercapto compounds and rhodanines. Specific examples of these compounds are described in U.S. Pat. Nos. 1,574,944, 2,410,689, 2,278,947, 3,501,313, 3,656,955, West German Patent No. 1,422,869, and Japanese Patent Publication Nos. 20533/1974 and 28568/1983. Among these compounds, thiosulfates, thioureas and rhodanines are particularly preferred.

Other chemical sensitizers that can be used in chemical ripening include: selenium compounds of the types described in U.S. Pat. Nos. 3,420,670, 3,297,447 and Unexamined Published Japanese Patent Application No. 71320/1975; reducing materials such as amines and stannous salts of the types described in U.S. Pat. Nos. 2,487,850, 2,518,698, 2,521,925, 2,521,926, 2,419,973, 2,694,637 and 2,983,610; and salts of noble metals such as platinum, palladium, iridium and rhodium of the types described in U.S. Pat. Nos. 2,448,060, 2,566,245 and 2,566,263.

In the present invention, good results are often obtained if chemical ripening with the gold compounds is performed in the presence of silver halide solvents such as thiocyanates, thioethers and 4-substituted thiourea.

Chemical ripening with the gold compounds can also be performed in the presence of chemical sensitization aids (chemical sensitization modifiers). Useful chemical sensitization aids (modifiers) are compounds such as 4-hydroxy-6-methyl-1,3,3a,7-tetrazaindene, guanosinc and sodium p-toluenesulfinate. Specific examples of chemical sensitization aids (modifiers) are described in U.S. Pat. Nos. 2,131,038, 3,411,914, 3,554,757, Unexamined Published Japanese Patent Application No. 126526/1983, and G. F. Duffin, "Photographic Emulsion Chemistry", The Focal Press, pp. 138–143, 1966.

The emulsion being subjected to chemical ripening preferably has a pAg (the logarithm of the reciprocal of silver ion concentration) of 7.0–11.0. The pit of the emulsion is preferably in the range of 4.0–9.0. The temperature for chemical ripening is preferably in the range of 40°–90° C.

The gold compounds of the general formula (I) can also be used preferably to insure that silver sulfide clusters grown and formed selectively at specific sites on the surfaces of silver halide grains by slowly adding sulfur sensitizers over time are converted to effective gold-silver sulfide clusters. For the techniques of selectively growing silver sulfide clusters, see Unexamined Published Japanese Patent Application No. 93447/1986.

The silver halide emulsion to be used in the present invention is preferably composed of silver bromide, silver iodobromide, silver iodochlorobromide of silver chlorobromide. At least 50% in number of the silver halide grains must contain 60 mol % or more of silver bromide. Desired silver halide emulsions can be prepared by known methods such as those described in P. Glafkides, "Chimie et Physique Rhotographique", Paul Montel, 1967, G. F. Duffin, "Photographic Emulsion Chemistry", The Focal Press, 1966, V. L. Zelikman et al., "Making and Coating Photographic Emulsions", The Focal Press, 1964.

Reverse precipitation, or the formation of grains In the presence of excess silver ions, can also be employed. As one version of double-jet precipitation, a "controlled double-jet method" can also be performed with a constant pAg being maintained in the liquid phase where silver halide is formed.

The silver halide emulsion to be used in the present invention may have a narrow or broad size distribution of silver halide grains.

The silver halide grains incorporated in the silver halide emulsion to be used in the present invention may have various crystallographic shapes such as regular forms (e.g. cubes, octahedra and tetradecahedra), anomalous forms (e.g. spheres), twinned faces, or combinations of these forms, The structure of silver halide crystals may be such that they have a substantially uniform composition, or they have a dual (core/shell) structure or a multi-layered structure, with a core/shell structure being preferred. In the case of silver halide grains having a core/shell structure, the interior (core) and the surface layer (shell) preferably have dissimilar halide compositions.

The gold compounds of the general formula (I) can also be used in sensitizing emulsions composed of tabular silver halide grains. Tabular silver halide grains are those which have a diameter to thickness ratio of at least 3. The "diameter" of a tabular silver halide grain means the diameter of a circle whose area is equal to the projected area of that grain, and the "thickness" is defined by the distance between two parallel faces by which the tabular grain is bounded. For the composition and structure of tabular silver halide grains, see the above description of silver halide grains.

The silver halide crystal grains in the silver halide emulsion to be used in the present invention may have silver halides of different compositions epitaxy-joined to matrix silver halide crystals. Alternatively, the matrix may be joined to other compounds than silver halides such as silver thiocyanate and lead oxide. The formation of silver halide grains or their physical ripening may be performed in the presence of compounds of chalcogens such as sulfur, selenium and tellurium, or cadmium salts, zinc salts, lead salts, thallium salts, iridium salts or complex salts thereof, or rhodium salts or complex salts thereof, or iron salts or complex salts thereof.

The interior of silver halide crystals may be subjected to reduction sensitization as described in Japanese Patent Publication No. 1410/1983 and Moisar et al., "Journal of Photographic Science", 25, 19–27, 1977.

Two or more separately prepared silver halide emulsions may be used as admixtures of suitable proportions in the present invention.

The silver halide emulsion to be used in the present invention may be spectrally sensitized with methine dyes and any other known dyes. Useful spectral sensitizers are described in, for example, German Patent No. 929,080, U.S. Pat. Nos. 2,231,658, 2,493,748, 2,503,776, 2,519,001, 2,912,329, 3,655,394, 3,656,959, 3,672,897, 3,694,217, BP No. 1,242,588, and Japanese Patent Publication No. 14030/1969. These spectral sensitizers may be used either on their own or as admixtures. Combinations of spectral sensitizers are often used for the particular purpose of super-sensitization, with typical examples of combined spectral sensitizers being described in U.S. Pat. Nos. 268,545, 2,977,229, 3,397,060, 3,522,052, 3,527,641, 3,617,293, 3,628,964, 3,666,480, 3,679,428, 3,703,377, 3,769,301, 3,814,609, 3,837,862, BP No. 1,344,281, Japanese Patent Publication No. 4936/1968, etc.

In addition to spectral sensitizers, the emulsion may contain dyes that have no spectrally sensitizing capability by themselves or those materials which are substantially incapable of absorbing visible light but which exhibit a supersensitizing effect. For example, the emulsion may contain aminostilbene compounds substituted by nitrogenous heterocyclic groups (as described in U.S. Pat. Nos. 2,933,390 and 3,635,721), condensates of aromatic organic acids and formaldehyde (as described in U.S. Pat. No. 3,743,510), cadmium salts or azaindene compounds. The combinations described in U.S. Pat. Nos. 3,615,613, 3,615,641, 3,617,295 and 3,635,721 are particularly useful.

For spectral sensitization of the silver halide emulsion used in the present invention, spectral sensitizers may be added at any stage, such as prior to, during or after the completion of chemical sensitization but good results are often obtained if the sensitizers are added before the start of chemical sensitization.

For the purpose of increasing sensitivity, contrast or the speed of development, the silver halide emulsion to be used in the present invention may contain various additives including polyalkylene oxides or derivatives thereof such as ethers, esters or amines, thioether compounds, thiomorpholines, quaternary ammonium compounds, urethane derivatives, urea derivatives, imidazole derivatives and 3-pyrazolidones. Useful compounds are described in U.S. Pat. Nos. 2,400,532, 2,423,549, 2,716,062, 3,617,280, 3,772,021 and 3,808,003.

The silver halide emulsion to be used in the present invention may also contain antifoggants and stabilizers. Useful compounds are described in Product Licensing Index, Vol. 92, p. 107 under "Antifoggants and stabilizers".

Known photographic addenda may be used in the silver halide emulsion. Compounds that are within the class of known photographic addenda are described in Research Disclosure (RD), No. 17643 (December 1978) and No. 18716 (November 1979) and summarized in the following table.

| Addenda | RD-17643 | | | RD-18716 |
|---|---|---|---|---|
| Chemical sensitizer | p. | 23 | III | p. 648, upper right column |
| Spectral sensitizer | p. | 23 | IV | p. 648, upper right column |
| Development accelerator | p. | 29 | XXI | p. 648, upper right column |
| Antifoggant | p. | 24 | VI | p. 649, lower right column |
| Stabilizer | p. | 24 | VI | p. 649, lower right column |
| Anti-color stain agent | p. | 25 | VII | p. 650, left and right columns |
| Image stabilizer | p. | 25 | VII | |
| UV absorber | pp. | 25–26 | VII | p. 649, right column to p. 650, left column |
| Filter dye | pp. | 25–26 | VII | p. 649, right column to p. 650, left column |
| Optical brightening agent | p. | 24 | V | |
| Hardener | p. | 26 | X | p. 651, right column |
| Coating aid | pp. | 26–27 | XI | p. 650, right column |
| Surfactant | pp. | 26–27 | XI | p. 650, right column |
| Plasticizer | p. | 27 | XII | p. 650, right column |
| Slip agent | p. | 27 | XII | |
| Antistatic agent | p. | 27 | XII | p. 650, right column |
| Matting agent | p. | 28 | XVI | p. 650, right column |
| Binder | p. | 26 | IX | p. 651, right column |

Emulsion layers in the silver halide photographic material of the present invention may incorporate dye-forming couplers that form dyes upon couling reaction with the oxidation product of aromatic primary amino compounds as developing agents (e.g. p-phenylenediamine derivatives and aminophenol derivatives) during color development. Dye-forming couplers are commonly selected in such a way that they form dyes that absorb spectral light to which the associated emulsion layers are sensitive. Thus, yellow dye forming couplers are used with a blue-sensitive emulsion layer, magenta dye forming couplers with a green-sensitive emulsion layer, and cyan dye forming couplers with a red-sensitive emulsion layer. However, various silver halide color photographic materials may be prepared using other combinations depending on a specific object.

The dye-forming couplers desirably have ballast groups in their molecule that have at least 8 carbon atoms and that render the couplers non-diffusible. The dye-forming couplers may be four-equivalent couplers that require four molecules of silver ion to be reduced to form one molecule of dye, or two-equivalent couplers that need only two molecules of silver ion to be reduced. Included within the class of dye-forming couplers are colored couplers that have a color correcting capability, as well as compounds that release photographically useful fragments upon coupling with the oxidation product of developing agents. Among these compounds, those which release development retarders as a function of development to improve the sharpness or granularity of image are called "DIR couplers".

In place of DIR couplers, DIR compounds that form colorless compounds as well as release development retarders upon coupling reaction with the oxidation product of developing agents may be used. Included within the class of useful DIR couplers and DIR compounds are compounds that are commonly referred to as "timing DIR couplers" and "timing DIR compounds". Development retarders released may be diffusible or may not be highly diffusible and these two types of retarders may be used either on their own or as admixtures depending on a specific object. Competitive couplers, or colorless couplers that enter into a coupling reaction with the oxidation product of aromatic primary amino compounds as developing agents but which will not form dyes, may be used in combination with dye-forming couplers.

Preferred yellow dye forming couplers may be selected from the class of known acylacetanillde containing couplers, among which benzoylacetanilide- and pivaloylacetanilide-containing compounds are particularly preferred. Useful magenta dye forming couplers include known 5-pyrazolone containing couplers, pyrazolobenzimidazole containing couplers, pyrazolotriazole containing couplers, open-chain acylacet-onitrile containing couplers, indazolone containing couplers, etc. Useful cyan dye forming couplers include known phenolic and naphtholic couplers, as typically exemplified by phenolic couplers substituted by, for example, alkyl, acylamino or ureido group, naphtholic couplers comprising a 5-aminonaphthol skeleton, and two-equivalent naphtholic couplers having an oxygen atom introduced in a leaving group.

The photographic material of the present invention which contains the silver halide emulsion defined hereinabove can be produced using known supports that have a high degree of flatness and that are so dimensionally stable as to experience little dimensional change during either manufacture or processing. Examples of such supports include cellulose nitrate films, cellulose ester films, polyvinyl acetal films, polystyrene films, polyethylene terephthalate films, polycarbonate films, glass, paper, metals and paper coated with polyolefins such as polyethylene and polypropylene. In order to provide improved adhesion to photographic emulsion layers, these supports may be subjected to various surface treatments that render them hydrophilic, such as saponification, corona discharge, subbing and setting.

The photographic material of the present invention can be processed using known photographic processing methods and solutions such as those described in Research Disclosure (RD) No. 17643, Item 176, pp. 20–30, December 1978. The photographic processing methods used may be black-and-white photography for producing silver image or color photography for producing dye image. The processing temperature typically ranges from 18° to 50° C. but satisfactory processing can be accomplished even if the temperature is lower than 18° C. or higher than 50° C.

Various color and black-and-white photographic materials can be produced using the silver halide emulsion defined hereinabove.

The present invention is particularly suitable for producing high-sensitivity color photographic materials. It is preferred to employ the following techniques in producing multi-layered color photographic materials: the technique of modifying the order of layer arrangement for achieving high sensitivity and high image quality at the same time; the technique of further improving granularity by dividing an emulsion layer having sensitivity to light of a certain color into three sub-layers; and the technique of further enhancing the sensitivity of a high-sensitivity layer, particularly a highly blue-sensitive layer, by providing an underlying reflective layer composed of fine silver halide grains. Among these techniques, those relating to the order of layer arrangement are described in such prior patents as U.S. Pat. Nos. 4,184,876, 4,129,446, 4,186,016, BP No. 1,560,965, U.S. Pat. Nos. 4,186,011, 4,267,264, 4,173,479, 4,157,917, 4,165,236, BP No. 2,138,962, Unexamined Published Japanese Patent Application No. 177552/1984, BP No. 2,137,372, and Unexamined Published Japanese Patent Application Nos. 180556/1984 and 204038/1984. The technique concerning reflective layers is described in Unexamined Published Japanese Patent Application No. 160135/1984.

The following examples are provided for the purpose of further illustrating the present invention but are in no way to be taken as limiting.

EXAMPLE 1

Using an apparatus of the type described in Unexamined Published Japanese Patent Application No. 160128/1987, a monodispersed, core/shell silver iodobromide emulsion (octahedral normal crystals; grain size as calculated for cubes, 1.0 μm; coefficient of variation in grain size, 16%; average AgI content, 9.5 mol %; high internal I content) was prepared.

The emulsion was divided into equal portions and to each portion, 140 mg of spectral sensitizers (D-1, D-2 and D-3), $3.2\times10^{-4}$ moles of ammonium thiocyanate, $3.0\times10^{-6}$ moles of sodium thiocyanate and $8.0\times10^{-8}$ moles of a gold compound (see Table 1 below) were added per mole of silver halide. The portions of the emulsion were subjected to optimum sulfur-plus-gold sensitization at 55° C. Thereafter. 850 mg of 4-hydroxy-6-methyl-1,3,3a, 7-tetrazaindene was added as a stabilizer.

Spectral sensitizer

D-1

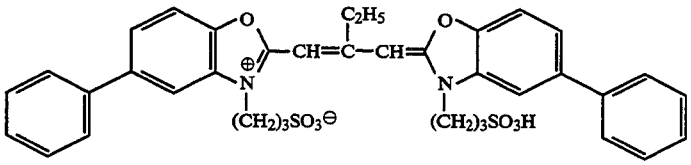

D-2

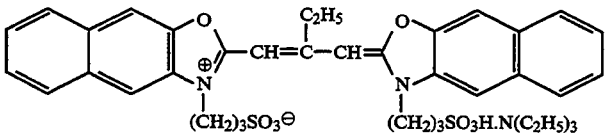

D-3

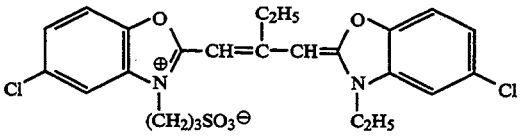

Subsequently, a magenta coupler {1-(2,4,6-trichlorophenyl)-3-[3-(2,4-di-t-amylphenoxyacetamido)benzamido]-5-pyrazolone} and a colored magenta coupler [1-(2,4,6-trichlorophenyl)-4-(1-naphthylazo)-3-(2-chloro-5-octadecenylsucinimidoanilino)-5-pyrazolone] were weighed in respective amounts of 80 g and 2.5 g per mole of silver halide and mixed with 120 g of tricresyl phosphate and 240 mg of ethyl acetate. The resulting mixture was heated and dispersed in a mixture of sodium triisopropylnaphthalenesulfonate (5 g) and 7.5% aqueous gelatin (550 ml). The thus formed coupler dispersion was added to the previously prepared emulsion samples.

Further, an appropriate amount of 2-hydroxy-4,6-dichlorotriazine sodium was added to each of the emulsion samples as a hardener and the resulting emulsions were applied onto subbed triacetate cellulose supports in a silver deposit of 2.0 g/m$^2$ and dried, whereby samples 1–7 were obtained.

Each of the thus obtained samples was divided into three parts: one part was left to stand for one day under natural conditions; the second part was aged under accelerated conditions by storage at 55° C. and at 204% r.h. for 3 days; and the third part was exposed to 100 mR of gamma-rays from 60 Co so as to estimate the effect of natural radiations. The thus conditioned samples were exposed through an optical wedge in the usual manner, color developed in accordance with the scheme shown below, and had their photographic performance evaluated. The results are shown in Table 1, in which "sensitivity" is expressed in terms of relative values, with the sensitivity of Comparative Sample 1 (left to stand at room temperature for one day under natural conditions) being taken as 100.

| Processing scheme (at 38° C.) | |
|---|---|
| Steps | Time |
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |
| Drying | |

The color developing, bleaching, fixing and stabilizing solutions used had the following compositions.

| | |
|---|---|
| **Color developing solution** | |
| 4-Amino-3-methyl-N-ethyl-N-β-hydroxyethylaniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetate trisodium salt (monohydrate) | 2.5 g |
| Potassium hydroxide | 1.0 g |
| Water | to make 1,000 ml |
| pH | adjusted to 10.6 with NAOH |
| **Bleaching solution** | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 g |
| Water | to make 1,000 ml |
| pH | adjusted to 6.0 with aqueous ammonia |
| **Fixing solution** | |
| Ammonium thiosulfate | 175.0 g |
| Anhydrous sodium sulfite | 8.6 g |
| Sodium metasulfite | 2.3 g |
| Water | to make 1,000 ml |
| pH | adjusted to 6.0 with acetic acid |
| **Stabilizing solution** | |
| Formaldehyde (37% aq. sol.) | 1.5 ml |
| Konidax (Konica Corp.) | 7.5 ml |
| Water | to make 1,000 ml |

TABLE 1

| Sample No. | Gold compound | 1-day standing under natural conditions fog | sensitivity | 3-day standing at 55° C. and 20% r.h. fog | sensitivity | Exposure to γ-rays (100 mR) fog | sensitivity | Remarks |
|---|---|---|---|---|---|---|---|---|
| 1 | Comparative compound 1 | 0.15 | 100 | 0.35 | 70 | 0.23 | 85 | Comparison |
| 2 | Comparative compound 2 | 0.14 | 102 | 0.25 | 85 | 0.21 | 87 | Comparison |
| 3 | Compound I-1 | 0.14 | 98 | 0.18 | 97 | 0.18 | 95 | Invention |
| 4 | Compound I-3 | 0.14 | 105 | 0.20 | 100 | 0.17 | 100 | Invention |
| 5 | Compound I-5 | 0.14 | 100 | 0.19 | 95 | 0.17 | 98 | Invention |
| 6 | Compound I-6 | 0.14 | 110 | 0.20 | 100 | 0.18 | 105 | Invention |
| 7 | Compound I-15 | 0.15 | 112 | 0.20 | 105 | 0.18 | 110 | Invention |

Comparative compound 1: $HAuCl_4.4H_2O$
Comparative compound 2: $Na_3[Au(S_2O_3)_2]$ As is clear from Table 1, samples 3–7 using compounds within the scope of the present invention were more stable to heat and gamma-rays (natural radiation) than samples 1 and 2 using the comparative compounds. Similar results were obtained when the emulsions for samples 1–7 were used in green-sensitive emulsion layers in multi-layered color photographic materials.

EXAMPLE 2

Emulsions comprising tabular monodispersed silver iodobromide grains were prepared by a double-jet method as in Example 1. The tabular grains had an average iodine content of 10.0 mol % (high internal I content), a grain size of 1.2 μm as calculated for cubes, a coefficient of variation of 24% in grain size, and a diameter to thickness ratio of 4.0.

Subsequently, the gold compounds used were evaluated as in Example 1. In Example 2, 1-ethyl-3-(2-thiazolyl)thiourea was used as a sulfur sensitizer in place of sodium thiosulfate. The results of evaluation are shown in Table 2, in which "sensitivity" is expressed in terms of relative values, with the sensitivity of sample 8 being taken as 100.

As is clear from Table 2, samples 10–13 using compounds within the scope of the present invention were more stable to heat and gamma-rays (natural radiation) than samples 8 and 9 using the comparative compounds.

TABLE 2

| Sample No. | Gold compound | 1-day standing under natural conditions fog | sensitivity | 3-day standing at 55° C. and 20% r.h. fog | sensitivity | Exposure to γ-rays (100 mR) fog | sensitivity | Remarks |
|---|---|---|---|---|---|---|---|---|
| 8 | Comparative compound 1 | 0.14 | 100 | 0.30 | 75 | 0.20 | 85 | Comparison |
| 9 | Comparative compound 2 | 0.14 | 100 | 0.23 | 87 | 0.19 | 90 | Comparison |
| 10 | Compound I-1 | 0.13 | 100 | 0.17 | 99 | 0.17 | 98 | Invention |
| 11 | Compound I-3 | 0.14 | 105 | 0.18 | 100 | 0.18 | 98 | Invention |
| 12 | Compound I-5 | 0.13 | 100 | 0.19 | 98 | 0.17 | 99 | Invention |
| 13 | Compound I-6 | 0.13 | 105 | 0.19 | 99 | 0.18 | 102 | Invention |

*Comparative compounds 1 and 2 were the same as in Example 1.

EXAMPLE 3

A core/shell tetradecahedral grain emulsion with 2 mol % AgI (high internal I content; grain size as calculated for cubes, 1.0 μm; coefficient of variation in grain size, 18%) was prepared as in Example 1.

Subsequently, the emulsion was divided into equal portions and to each portion, $4.4\times10^{-6}$ moles of sodium thiosulfate, $1.2\times10^{-3}$ moles of ammonium thiocyanate and $1.2\times10^{-6}$ moles of a gold compound (see Table 3) were added per mole of silver halide. The portions of the emulsion were subjected to optimal sulfur-plus-gold sensitization at 55° C.

After chemical ripening, 4-hydroxy-6-methyl-1,3,3a,7-tetrazaindene (stabilizer), saponin (coating aid) and 2,4-dichloro-6-hydroxy-s-triazine (hardener) were added in appropriate amounts to each emulsion. The resulting emulsions were applied onto subbed polyester supports and dried to prepare samples 14–19.

Each of the thus prepared samples was divided into three parts: one part was left to stand for one day under natural conditions; the second part was aged under accelerated conditions by storage at 55° C. and at 20% r.h. for 3 days; and the third part was exposed to 100 mR of gamma-rays from 60 Co.

The thus conditioned samples were exposed through a conventional sensitometric wedge for 1/50 sec and subsequently developed with a developing solution (see below) at 35° C. for 30 sec. Following fixing, washing and drying, the photographic performance of the processed samples was evaluated for sensitivity and fogging, with the results being shown in Table 3.

Photographic sensitivity is expressed by the reciprocal of the logarithm of the amount of exposure necessary to provide an optical density of (fog+0.1) and in Table 3, "sensitivity" is expressed in terms of relative values, with the sensitivity of sample 14 being taken as 100.

| Developing solution for black-and-white photography | |
|---|---|
| 1-Phenyl-3-pyrazolidone | 1.5 g |
| Hydroquinone | 30.0 g |
| 5-Nitroindazole | 0.25 g |
| Potassium bromide | 5.0 g |
| Anhydrous potassium sulfite | 55.0 g |
| Potassium hydroxide | 30.0 g |
| Boric acid | 10.0 g |
| Glutaraldehyde (25%) | 5.0 g |
| Water | to make 1,000 ml |

TABLE 3

| Sample No. | Gold compound | 1-day standing under natural conditions fog | sensitivity | 3-day standing at 55° C. and 20% r.h. fog | sensitivity | Exposure to γ-rays (100 mR) fog | sensitivity | Remarks |
|---|---|---|---|---|---|---|---|---|
| 14 | Comparative compound 1 | 0.02 | 100 | 0.05 | 98 | 0.04 | 97 | Comparison |
| 15 | Compound I-1 | 0.01 | 102 | 0.02 | 106 | 0.02 | 104 | Invention |
| 16 | Compound I-3 | 0.01 | 100 | 0.02 | 103 | 0.02 | 103 | Invention |
| 17 | Compound I-5 | 0.01 | 107 | 0.02 | 108 | 0.02 | 105 | Invention |
| 18 | Compound I-6 | 0.01 | 110 | 0.02 | 110 | 0.03 | 105 | Invention |
| 19 | Compound I-15 | 0.02 | 115 | 0.03 | 120 | 0.03 | 110 | Invention |

*Comparative compound 1 was the same as used in Example 1.

As Table 3 shows, samples 15–19 using compounds within the scope of the present invention were more stable to heat and γ-rays than sample 14 using comparative compound 1.

What is claimed is:

1. A silver halide photographic material having photographic constituent layers on a support, wherein at least one of said photographic constituent layers is a silver halide emulsion layer, at least 50% in number of the light-sensitive silver halide grains in said silver halide emulsion layer being grains that contain at least 60 mol % of silver bromide, said grains having a core/shell structure, said core having a higher iodide content than said shell, and at least one of said silver halide emulsion layers containing at least one of the compounds represented by the following general formula (I):

$$[H_lAu_m(L)_n(X)_p]_q \quad (I)$$

where L is a ligand in a 5- or 6-membered hetero ring; X is an anionic group; l is an integer of 0–2; m is an integer of 1 or 2; n is an integer of 1–3; p is an integer of 0–3; and q is an integer of 1–4.

2. The silver halide photographic material according to claim 1 wherein the compound of formula (I) is selected from the group consisting of

I-8

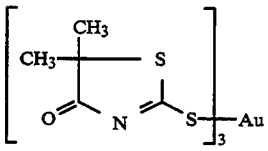

I-9

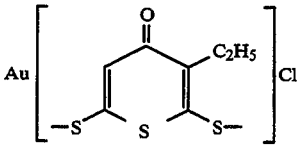

I-10

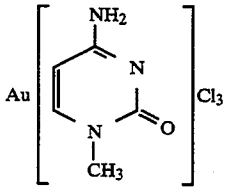

I-11

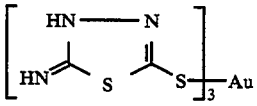

I-12

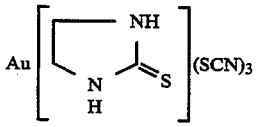

I-13

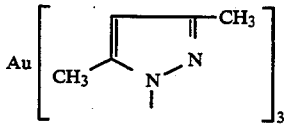

-continued

I-14

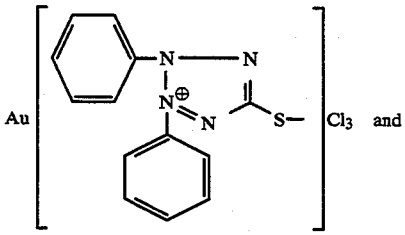

and

-continued

I-15

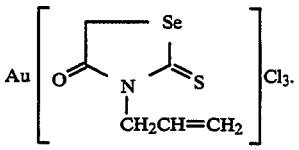

3. The silver halide photographic material according to claim 1 wherein the compound represented by the general formula (I) is contained in an amount of $1\times10^{-4}$ to $1\times10^{-8}$ mole per mole of silver halide.

4. The silver halide photographic material according to claim 3 wherein the compound represented by the general formula (I) is contained in an amount of $1\times10^{-5}$ to $1\times10^{-8}$ mole per mole of silver halide.

* * * * *